US006843650B2

(12) United States Patent
Lin

(10) Patent No.: US 6,843,650 B2
(45) Date of Patent: Jan. 18, 2005

(54) CIGARETTE LIGHTER

(76) Inventor: Hwai-Tay Lin, Akara Building, 24 De Castro Street, Wickhams Cay I, Road Town, Tortola (VG)

( * ) Notice: Subject to any disclaimer, the term of this patent is extended or adjusted under 35 U.S.C. 154(b) by 0 days.

(21) Appl. No.: 10/227,967

(22) Filed: Aug. 26, 2002

(65) Prior Publication Data

US 2004/0038165 A1 Feb. 26, 2004

(51) Int. Cl.[7] ..... F23Q 2/40
(52) U.S. Cl. ..... 431/132; 431/134; 431/135
(58) Field of Search ..... 431/132, 134, 431/135, 151, 153, 255

(56) References Cited

U.S. PATENT DOCUMENTS 2,867,753 A * 1/1959 Quandt ..... 431/132
4,487,570 A * 12/1984 Lowenthal ..... 431/132
6,129,544 A * 10/2000 Chen ..... 431/153
6,142,766 A * 11/2000 Hu ..... 431/132
6,527,542 B1 * 3/2003 Chen ..... 431/153
2004/0115579 A1 * 6/2004 Lin ..... 431/153
2004/0185407 A1 * 9/2004 Lin ..... 431/132

FOREIGN PATENT DOCUMENTS

JP 59-167634 A * 9/1984 ..... 431/255

* cited by examiner

*Primary Examiner*—Sara Clarke
(74) *Attorney, Agent, or Firm*—Alan D. Kamrath; Nikolai & Mersereau, P.A.

(57) ABSTRACT

A cigarette lighter includes a shell, a nozzle, an ignition device, a button, a cap and a linkage. The shell includes a reservoir for fuel. The nozzle is in communication with the reservoir through a pipe. The ignition device includes a wire extending to the vicinity of the nozzle. The button is connected with the ignition device. The button is movable between a locking position, a first operative position and a second operative position. The cap is mounted on the shell for covering the nozzle. The linkage is connected between the button and the cap. The linkage locks the cap in the locking position. The linkage releases the cap in the first operative position. The ignition device creates electric arcs between a free end of the wire and the nozzle in the second operative position.

14 Claims, 5 Drawing Sheets

CIGARETTE LIGHTER

BACKGROUND OF INVENTION

1. Field of Invention

The present invention relates to a cigarette lighter.

2. Related Prior Art

Taiwan Patent Publication No. 441760 discloses a conventional cigarette lighter. In use of this conventional cigarette lighter, a cover 12 must be lifted from the shell 10 before a toothed wheel 23 can be rotated against a flint 20 in order to produce a spark. If the spark fails to ignite gas vented from a nozzle 38, the toothed wheel 23 has to be rotated against the flint 20 again in order to produce another spark. In outdoor use of this conventional cigarette lighter, particularly in windy weather, the toothed wheel 23 often has to be rotated against the flint 20 several times before a spark successfully ignites gas vented from a nozzle 38. This is inconvenient.

The present invention is therefore intended to obviate or at least alleviate the problem encountered in the prior art.

SUMMARY OF INVENTION

It is an objective of the present invention to provide a convenient cigarette lighter.

According to the present invention, a cigarette lighter includes a shell, a nozzle, an ignition device, a button, a cap and a linkage. The shell includes a reservoir for fuel. The nozzle is in communication with the reservoir through a pipe. The ignition device includes a wire extending to the vicinity of the nozzle. The button is connected with the ignition device. The button is movable between a locking position, a first operative position and a second operative position. The cap is mounted on the shell for covering the nozzle. The linkage is connected between the button and the cap. The linkage locks the cap in the locking position. The linkage releases the cap in the first operative position. The ignition device creates electric arcs between a free end of the wire and the nozzle in the second operative position.

Other objectives, advantages, and novel features of the invention will become more apparent from the following detailed description when taken in conjunction with the attached drawings.

DETAILED DESCRIPTION OF PREFERRED EMBODIMENT

Figure 1:
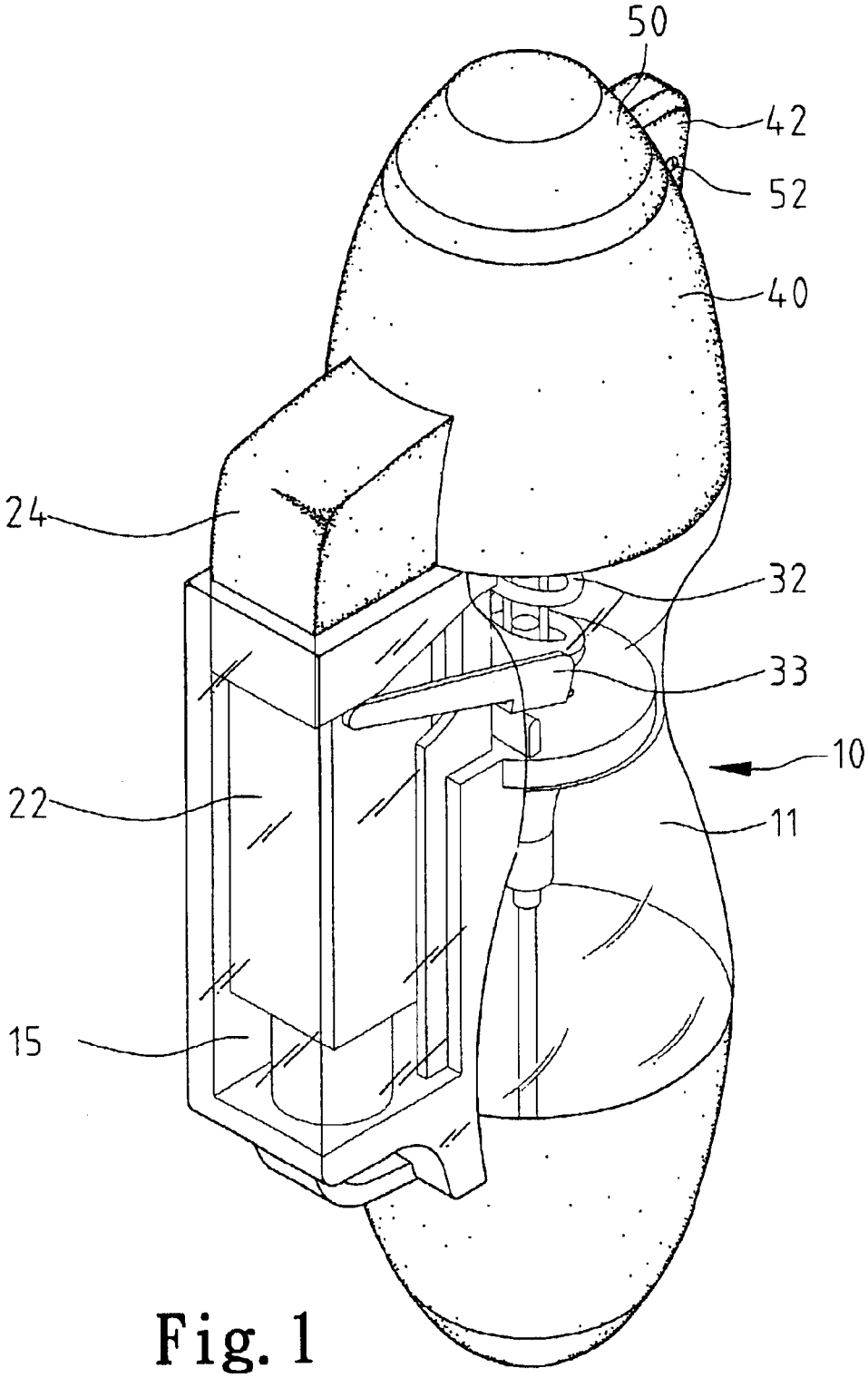
FIG. 1 is a perspective view of a cigarette lighter according to the present invention.
Figure 2:
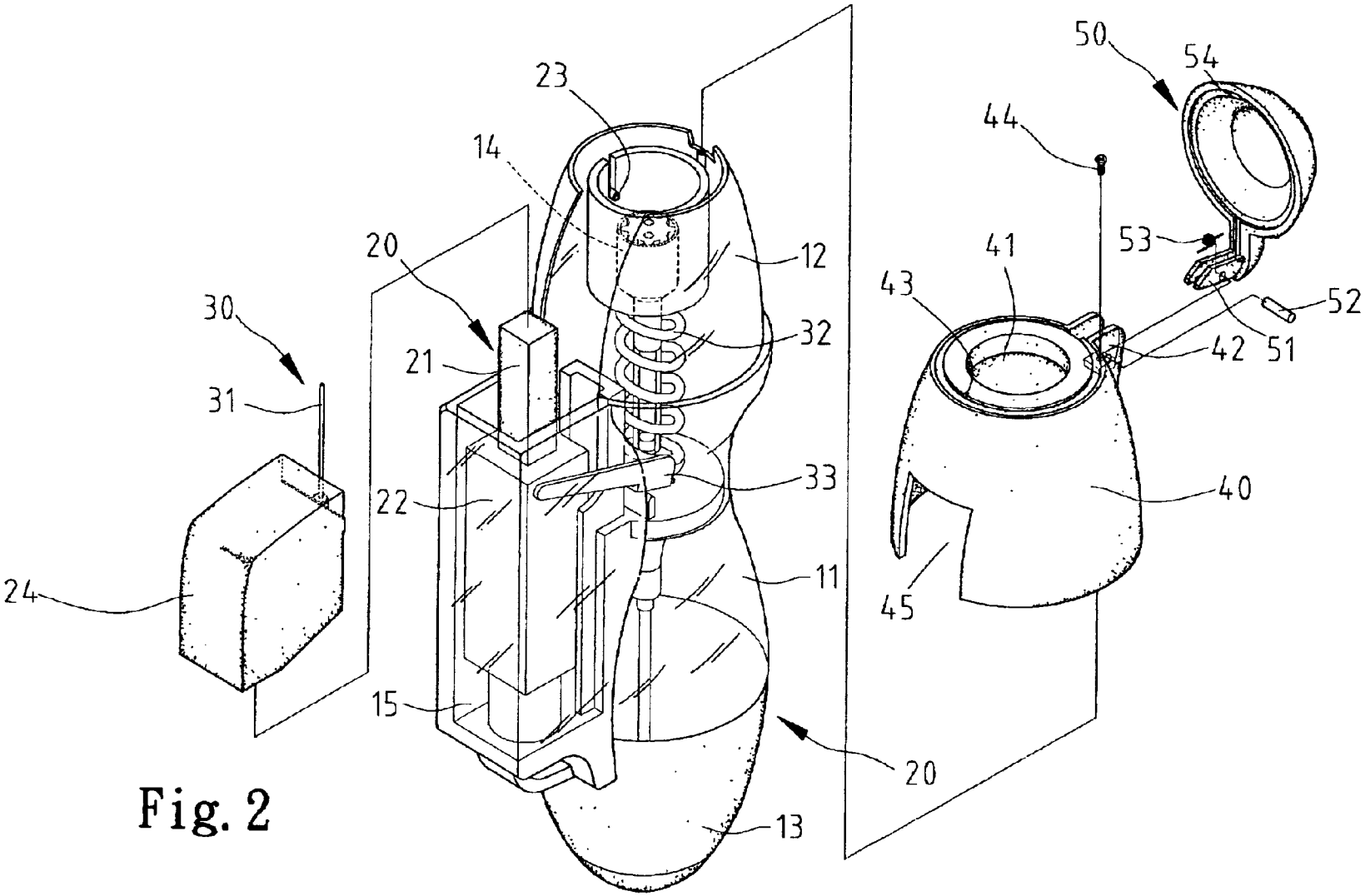
FIG. 2 is an exploded view of the cigarette lighter according to the present invention.
Figure 3:
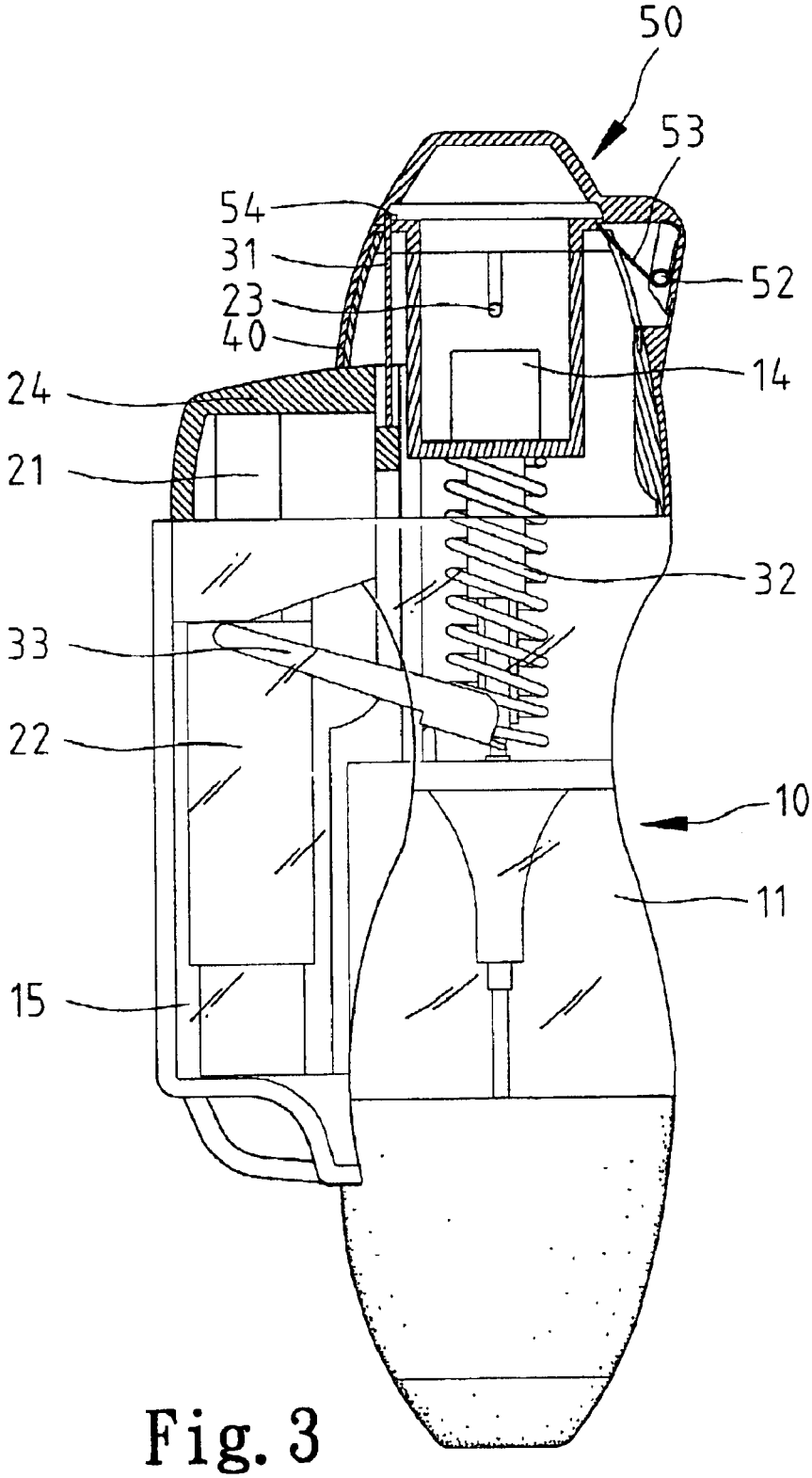
FIG. 3 is a cross-sectional view of the cigarette lighter according to the present invention.

Referring to FIGS. 1–3, according to the preferred embodiment of the present invention, a cigarette lighter includes a shell 10 including a reservoir 11 for storing fuel and a container 15 for containing an ignition device 20. The reservoir 11 and the container 15 are integrated. A valve is mounted on the reservoir 11. The shell 10 includes an upper end 12 and a lower end 13. A nozzle 14 is secured to the upper end 12 of the shell 10. The nozzle 14 is in communication with the reservoir 11 through a pipe.

The ignition device 20 includes a piston 21, a cylinder 22, a wire 23 and a button 24. The cylinder 22 is received in the container 15. A circuit (not shown) is received in the cylinder 22. The piston 21 includes an upper end located outside the cylinder 22 and a lower end inserted in the cylinder 22. The wire 23 includes an end connected with the circuit and a free end extending to the vicinity of the nozzle 14. The button 24 is mounted on the piston 21. Thus, when the button 24 and therefore the piston 21 are pushed, electricity is sent from the circuit to the free end of the wire 23. An electric arc is produced between the free end of the wire 23 and the nozzle 14.

A linking device 30 includes a rod 31, a spring 32 and a lever 33. The rod 31 includes a lower end and an upper end. The lower end of the rod 31 is attached to the button 24 so that they are movable together. The spring 32 is located beneath the nozzle 14. The lever 33 includes a first end in contact with the button 24 and a second end pressed under the spring 32.

A collar 40 includes a central aperture 41 defined therein, two ears 42 formed thereon, an eccentric aperture 43 defined therein and a cutout 45 defined therein. Each of ears 42 defines an aperture (not numbered). The collar 40 is secured to the upper end 12 of the shell 10 by means of a screw 44. The upper end of the rod 31 is inserted through the aperture 43. The second end of the lever 33 is inserted through the cutout 45.

A cap 50 includes two ears 51 formed thereon and a recess 54 defined in an internal face thereof. Each of the ears 51 defines an aperture (not numbered). In assembly, the ears 51 are located between the ears 42, and a pin 52 is inserted in the apertures of the ears 42, the apertures of the ears 51 and a spring 53. Thus, the cap 50 is pivotally mounted on the collar 40, and the spring 53 tends to lift the cap 50 from the collar 40.

Referring to FIG. 3, when the collar 40 is closed via the cap 50, the upper end of the rod 31 is fit in the recess 54 in order to retain the collar 40 closed via the cap 50.

Figure 4:
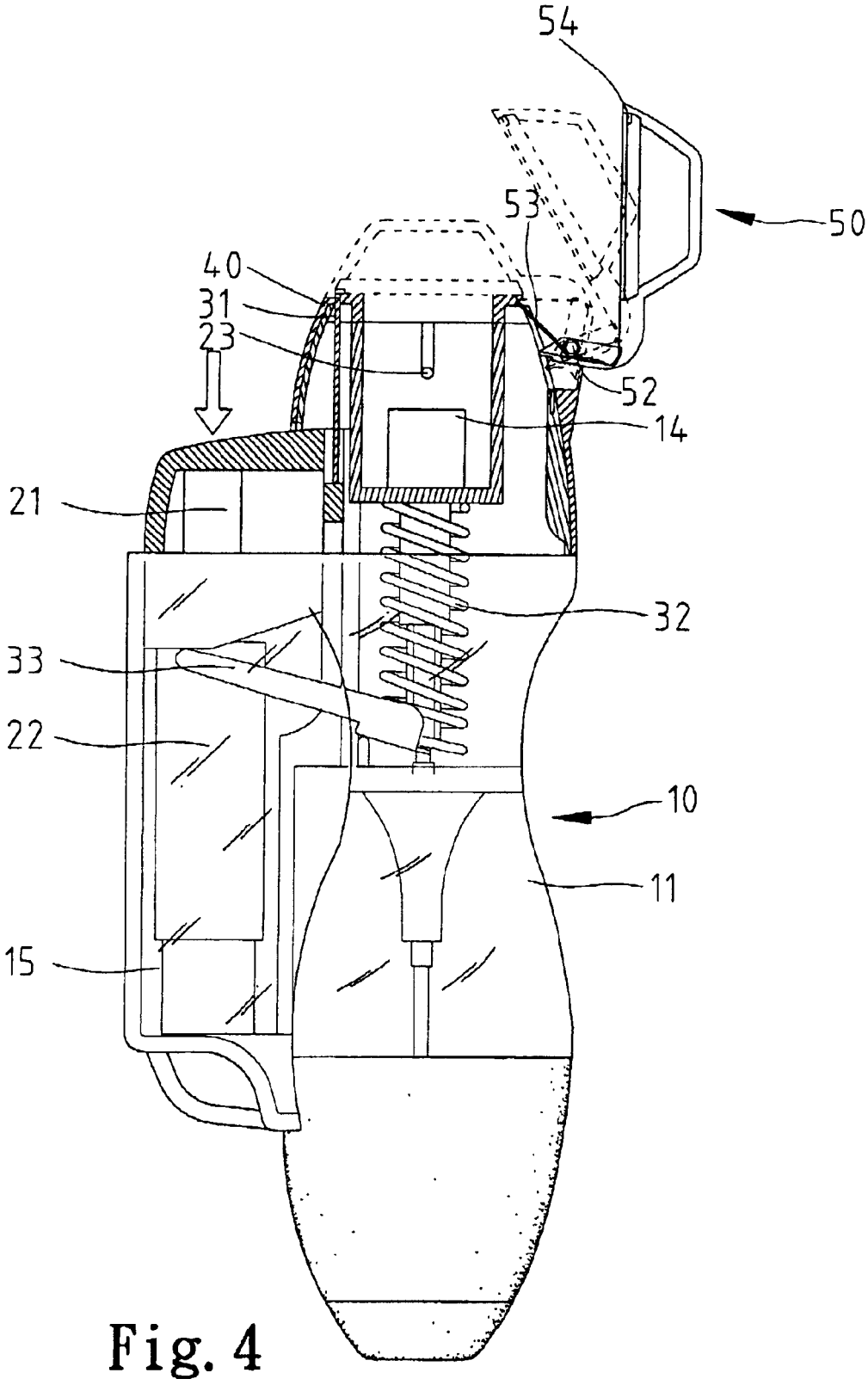
FIG. 4 is similar to FIG. 3 but showing a cover in an open position.

Referring to FIG. 4, when the button 24 is pushed to a first operative position relative to the shell 10, the button 24 pushes down the first end of the lever 33 so that the second end of the lever 33 pushes up the lower end of the spring 32. As the button 24 is pushed down, the upper end of the rod 31 is moved from the recess 54. The spring 53 lifts the cap 50 from the collar 40.

Figure 5:
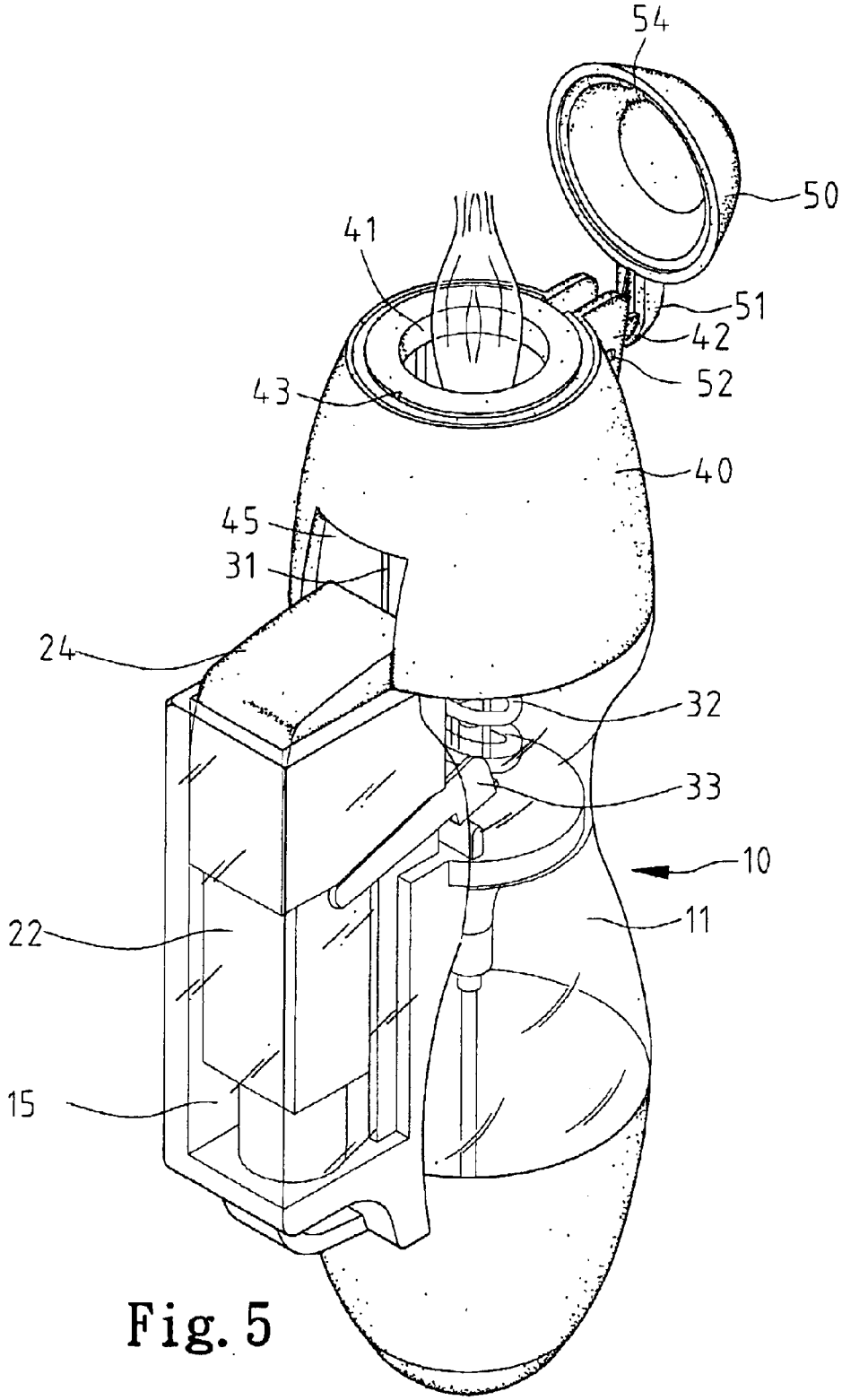
FIG. 5 is similar to FIG. 1 but showing the cigarette lighter producing fire.

Referring to FIG. 5, when the button 24 is pushed to a second operative position relative to the shell 10, the ignition device 20 is activated in order to create electric arcs between the free end of the wire 23 and the nozzle 14 as to ignite gas vented from the nozzle 14.

As soon as the button 24 is released, the spring 32 pushes down the second end of the lever 33 and therefore moves up the first end of the lever 33. Thus, the button 24 is moved back to its original position.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A cigarette lighter including:

a shell, including a reservoir for fuel;

a nozzle in communication with the reservoir through a pipe;

an ignition device including a wire extending to the vicinity of the nozzle;

a button connected with the ignition device wherein the button is movable in a pushing direction between a locking position, a first operative position and a second operative position;

a cap mounted on the shell for covering the nozzle; and a linkage attached to the button, with the linkage having an end moveable with the button in the pushing direction and connected with the cap so that the linkage locks the cap in the locking position, that the linkage releases the cap in the first operative position, and that the ignition device creates electric arcs between a free end of the wire and the nozzle in the second operative position.

2. The cigarette lighter according to claim 1 wherein the cap defines a recess, and the linkage includes a rod including a lower end attached to the button and an upper end that is fit in the recess of the cap in the locking position and is released from the recess of the cap in the first operative position.

3. The cigarette lighter according to claim 1 including a spring connected between the shell and the cap for lifting the cap from the shell.

4. The cigarette lighter according to claim 1 including a collar mounted on the shell, wherein the cap is mounted on the collar.

5. The cigarette lighter according to claim 4 wherein the cap defines a recess, and the linkage includes a rod including a lower end attached to the button and an upper end that is fit in the recess of the cap in the locking position and is released from the recess of the cap in the first operative position.

6. The cigarette lighter according to claim 1 wherein the ignition device includes a cylinder mounted on the shell and a piston including a lower end inserted in the cylinder and an upper end in contact with the button.

7. The cigarette lighter according to claim 1 wherein the shell includes a container integrated with the reservoir in order to contain the ignition device.

8. A cigarette lighter including:

a shell including a reservoir for fuel;

a nozzle in communication with the reservoir through a pipe;

an ignition device including a wire extending to the vicinity of the nozzle;

a button connected with the ignition device wherein the button is movable between a locking position, a first operative position and a second operative position;

a cap mounted on the shell for covering the nozzle; and a linkage connected between the button and the cap so that the linkage locks the cap in the locking position, that the linkage releases the cap in the first operative position, and that the ignition device creates electric arcs between a free end of the wire and the nozzle in the second operative position, wherein the linkage includes:

a spring including an upper end in contact with the nozzle and a lower end; and a lever including a first end in contact with the button and a second end in contact with the lower end of the spring so that the spring moves the button back to the locking position via the lever when the button is released.

9. The cigarette lighter including:

a shell including a reservoir for fuel;

a nozzle in communication with the reservoir through a pipe;

an ignition device including a wire extending to the vicinity of the nozzle;

a button connected with the ignition device wherein the button is movable between a locking position, a first operative position and a second operative position;

a cap mounted on the shell for covering the nozzle;

a linkage connected between the button and the cap so that the linkage locks the cap in the locking position, that the linkage releases the cap in the first operative position, and that the ignition device creates electric arcs between a free end of the wire and the nozzle in the second operative position; and a collar mounted on the shell, wherein the cap is mounted on the collar, wherein the cap defines a recess, and the linkage includes a rod including a lower end attached to the button and an upper end that is fit in the recess of the cap in the locking position and is released from the recess of the cap in the first operative position, and wherein the collar defines an aperture through which the upper end of the rod is inserted.

10. A cigarette lighter including:

a shell including a reservoir for fuel;

a nozzle in communication with the reservoir through a pipe;

an ignition device including a wire extending to the vicinity of the nozzle;

a button connected with the ignition device wherein the button is movable between a locking position, a first operative position and a second operative position;

a cap mounted on the shell for covering the nozzle;

a linkage connected between the button and the cap so that the linkage locks the cap in the locking position, that the linkage releases the cap in the first operative position, and that the ignition device creates electric arcs between a free end of the wire and the nozzle in the second operative position; and a collar mounted on the shell wherein the cap is mounted on the collar, wherein the collar includes two ears formed thereon, and the cap includes at least one ear located between and pivotally connected with the ears of the collar.

11. The cigarette lighter according to claim 10, including a pin inserted through the ears of the collar and the at least one ear of the cap.

12. The cigarette lighter according to claim 11 wherein the cap includes two ears through which the pin is inserted.

13. The cigarette lighter according to claim 12 including a spring mounted on the pin and connected between the collar and the cap for lifting the cap from the shell.

14. A cigarette lighter including:

a shell including a reservoir for fuel;

a nozzle in communication with the reservoir through a pipe;

an ignition device including a wire extending to the vicinity of the nozzle;

a button connected with the ignition device wherein the button is movable between a locking position, a first operative position and a second operative position;

a cap mounted on the shell for covering the nozzle;

a linkage connected between the button and the cap so that the linkage locks the cap in the locking position, that the linkage releases the cap in the first operative position, and that the ignition device creates electric arcs between a free end of the wire and the nozzle in the second operative position;

a collar mounted on the shell wherein the cap is mounted on the collar; and a screw for securing the collar to the shell.

* * * * *